US008596089B2

(12) United States Patent
Darke et al.

(10) Patent No.: US 8,596,089 B2
(45) Date of Patent: Dec. 3, 2013

(54) REFRIGERANT DISTRIBUTION SYSTEM

(75) Inventors: Ranjit Darke, Los Angeles, CA (US); Peter Zheng, Los Angeles, CA (US)

(73) Assignee: Honeywell International Inc., Morristown, NJ (US)

( * ) Notice: Subject to any disclaimer, the term of this patent is extended or adjusted under 35 U.S.C. 154(b) by 1028 days.

(21) Appl. No.: 12/393,908

(22) Filed: Feb. 26, 2009

(65) Prior Publication Data

US 2010/0212353 A1 Aug. 26, 2010

(51) Int. Cl.
*F25B 39/02* (2006.01)
*F28F 9/02* (2006.01)
*F28D 1/02* (2006.01)

(52) U.S. Cl.
USPC ..... 62/525; 165/174; 165/153; 165/176

(58) Field of Classification Search
USPC ..... 62/515, 525
See application file for complete search history.

(56) References Cited

U.S. PATENT DOCUMENTS 5,448,899 A * 9/1995 Ohara et al. ..... 62/525
5,704,221 A * 1/1998 Lego ..... 62/525
6,205,807 B1 * 3/2001 Broadbent ..... 62/347
6,318,118 B2 11/2001 Hanson et al.
6,449,979 B1 9/2002 Nagasawa et al.
7,252,140 B2 * 8/2007 Glezer et al. ..... 165/80.3
7,331,195 B2 * 2/2008 Bae et al. ..... 62/504
7,587,911 B2 * 9/2009 Yanik et al. ..... 62/515
2005/0126770 A1 * 6/2005 Higashiyama ..... 165/174
2006/0162376 A1 * 7/2006 Higashiyama et al. ..... 62/515
2006/0201198 A1 * 9/2006 Nishino et al. ..... 62/525
2006/0288716 A1 12/2006 Knight et al.
2007/0074861 A1 * 4/2007 Higashiyama ..... 165/174
2007/0169510 A1 * 7/2007 Ishizaka et al. ..... 62/500
2007/0204983 A1 * 9/2007 Ichiyanagi ..... 165/176
2008/0041092 A1 2/2008 Gorbounov et al.
2008/0289800 A1 11/2008 Simadiris et al.

* cited by examiner

*Primary Examiner* — Brandon M Rosati
*Assistant Examiner* — Dawit Muluneh
(74) *Attorney, Agent, or Firm* — Shimokaji & Assoc., P.C.

(57) ABSTRACT

A refrigerant distribution system has a plurality of chambers formed inside a refrigerant distribution plate, each of the plurality of chambers extending from one end of the refrigerant distribution plate into the refrigerant distribution plate; and a plurality of holes formed in each of the plurality of chambers, the plurality of holes fluidly communicating each of the plurality of chambers with an outside of the refrigerant distribution place. The evaporator may be oriented such that the refrigerant flows horizontally with respect to gravity. The present invention may improve the thermal performance of the evaporator while the evaporator is oriented sub-optimally. Often, with horizontal flow through an evaporator, the refrigerant phases, liquid and vapor, may separate in the manifold, resulting in poor distribution of refrigerant in the evaporator core. The refrigerant distribution plate of the present invention evenly distributes the refrigerant in the core.

11 Claims, 5 Drawing Sheets

REFRIGERANT DISTRIBUTION SYSTEM

BACKGROUND OF THE INVENTION

The present invention relates to a refrigerant distribution system, and more specifically, to a refrigerant distribution system having an evaporator that may be oriented such that the refrigerant flows horizontally.

Aircraft often use refrigerant systems to reject heat in galley cooling, electronics cooling and air conditioning. Refrigerant evaporators which boil off liquid refrigerant to cool off another media are susceptible to performance degradation due to gravitational orientation. In aircraft applications, it is not always possible to orient the evaporator in the optimal orientation with respect to gravity.

The optimal orientation in terms of performance is a vertical flow path, such that refrigerant flows against gravity. Less than optimal orientations allow the liquid refrigerant to separate from the vapor refrigerant resulting in liquid refrigerant distribution and performance less than what may be found with the optimal orientation.

To further complicate the problem, many refrigerant systems contain oil that is used to lubricate the compressor. A small portion of the oil tends to escape from the compressor and is circulated throughout the system. The oil must eventually be returned to the compressor to ensure proper lubrication and operation of the compressor.

At the evaporator, the liquid refrigerant evaporates and the oil separates from the refrigerant. The velocity in the evaporator must be large enough to overcome gravity and friction to return the oil to the compressor. In terms of oil return, the evaporator prefers to be oriented such that the refrigerant is flowing down with gravity so that gravity is actually assisting oil return. The optimal orientation for oil return and thermal performance are in conflict.

Many evaporators must compromise thermal performance due to orientation with respect to gravity in order to aid in oil return. This results in a heavier evaporator.

As can be seen, there is a need for a refrigerant distribution system that maximizes thermal performance of the evaporator when the evaporator is in a non-optimal thermal performance orientation.

SUMMARY OF THE INVENTION

In one aspect of the present invention, a refrigerant distribution plate comprises a plurality of chambers formed inside the refrigerant distribution plate, each of the plurality of chambers extending from one end of the refrigerant distribution plate into the refrigerant distribution plate; and a plurality of holes formed in each of the plurality of chambers, the plurality of holes fluidly communicating each of the plurality of chambers with an outside of the refrigerant distribution plate.

In another aspect of the present invention, an evaporator comprises an evaporator core receiving a fluid to be cooled; and a refrigerant distribution plate for distributing refrigerant into the evaporator core, wherein the refrigerant distribution plate comprises a plurality of chambers formed inside the refrigerant distribution plate, each of the plurality of chambers extending from one end of the refrigerant distribution plate into the refrigerant distribution plate; and a plurality of holes formed in each of the plurality of chambers, the plurality of holes fluidly communicating each of the plurality of chambers with an outside of the refrigerant distribution place.

In a further aspect of the present invention, a method for distributing refrigerant into an evaporator core comprises delivering refrigerant into a plurality of tube-shaped chambers, the chambers running along a width of the evaporator core; and flowing the refrigerant out of the chambers through a plurality of holes formed in each of the chambers, the holes directing the refrigerant into the evaporator core.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, embodiments of the present invention provide refrigerant distribution systems having an evaporator oriented such that the refrigerant flows horizontally with respect to gravity. The present invention may improve the thermal performance of the evaporator while the evaporator is oriented sub-optimally with respect to thermal performance, oil recovery, or both. Often, with horizontal flow through an evaporator, the refrigerant phases, liquid and vapor, may separate in the manifold, resulting in poor distribution of refrigerant in the evaporator core. The refrigeration distribution plate of the present invention may evenly distribute the refrigerant in the core.

Figure 1:
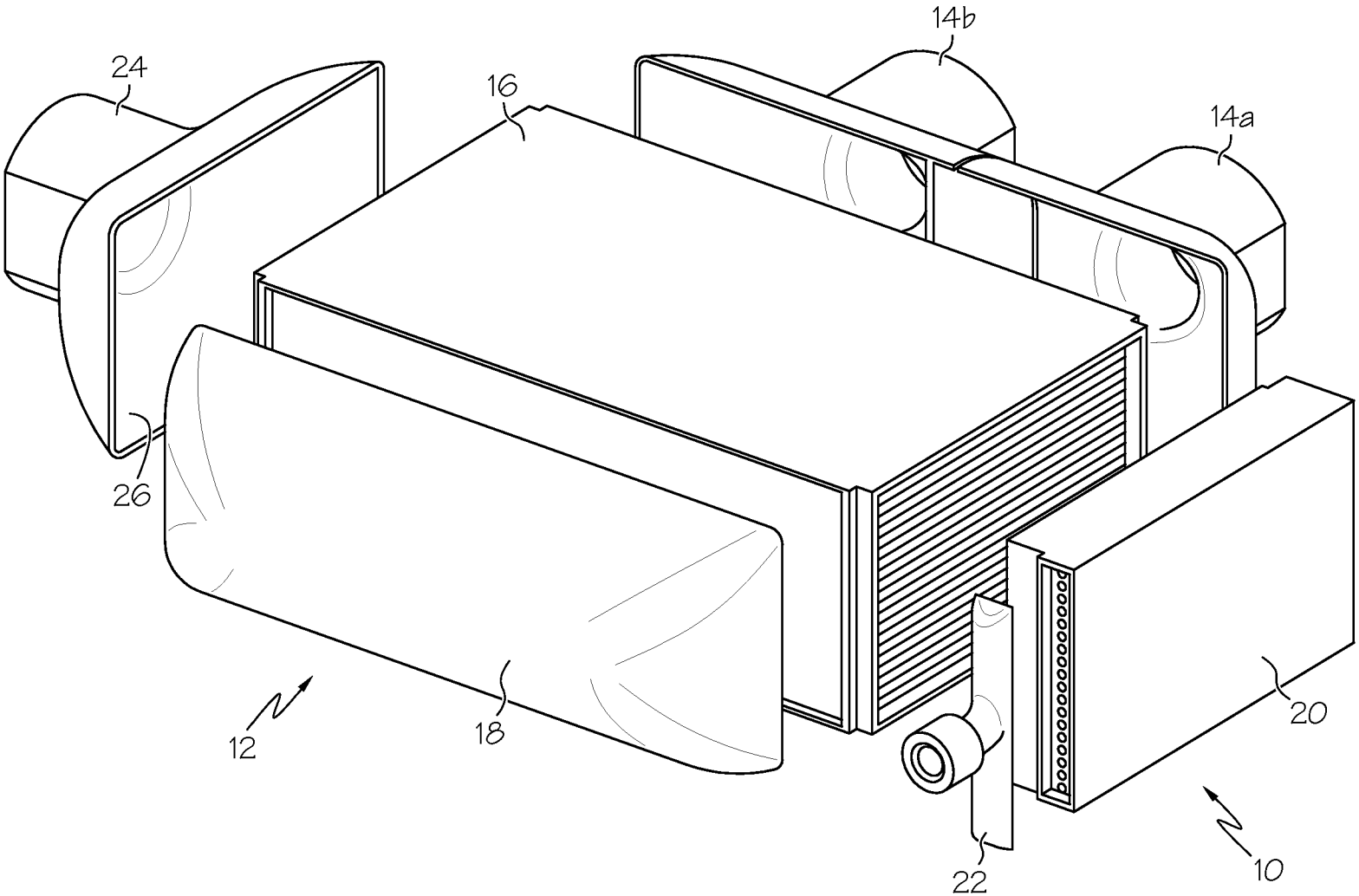
FIG. 1 is a perspective exploded back view of a refrigerant distribution system according to an embodiment of the present invention as installed on an evaporator.
Figure 2:
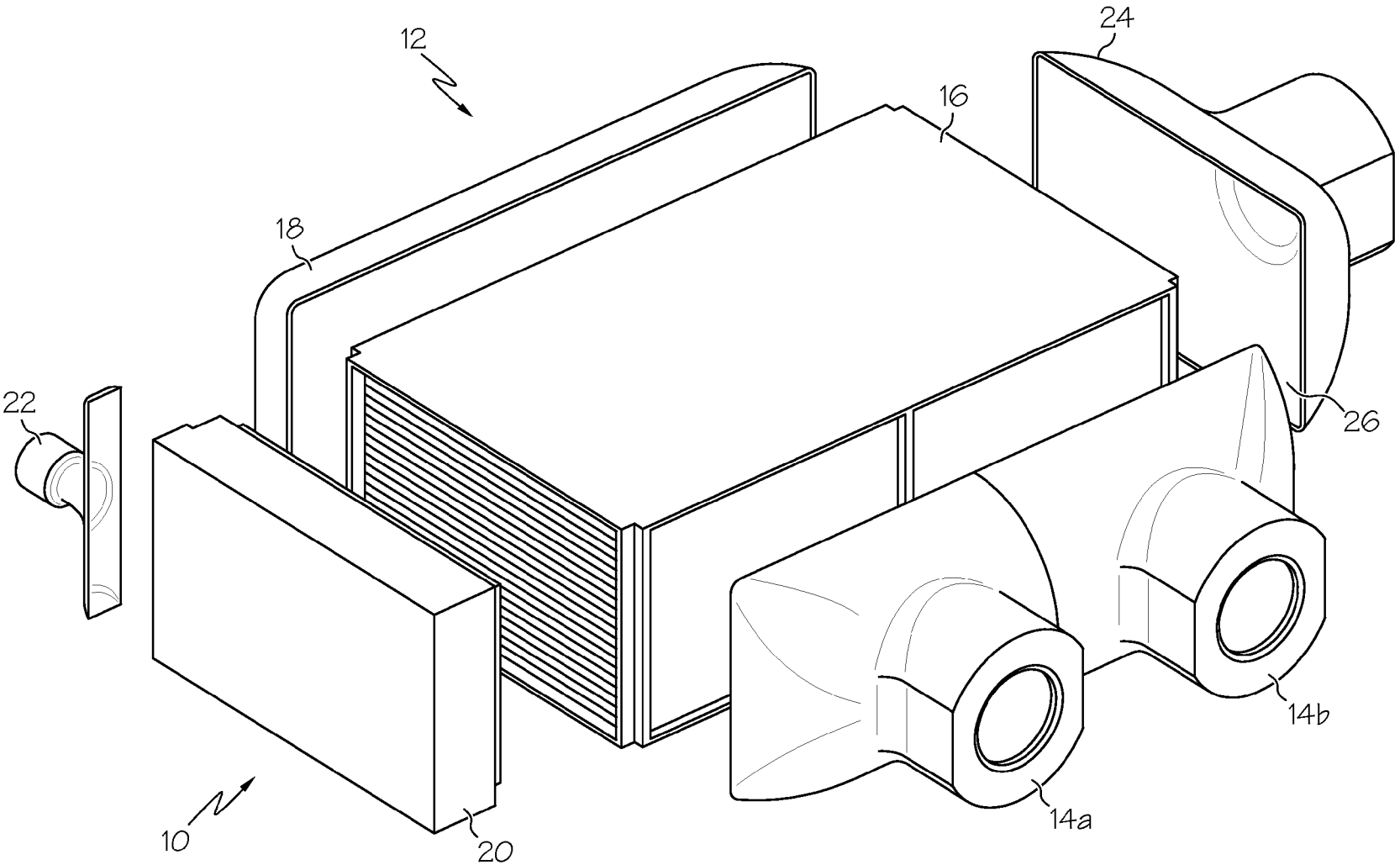
FIG. 2 is a perspective exploded front view of the refrigerant distribution system of FIG. 1.

Referring to FIGS. 1 and 2, there are shown perspective exploded front and back views of a refrigerant distribution system 10, according to an embodiment of the present invention, as installed on an evaporator 12. The evaporator 12 may include a fluid flow inlet 14*a* and outlet 14*b*, through which a fluid, such as air, may pass through to be cooled within an evaporator core 16. The evaporator 12 of FIGS. 1 and 2 may also include an end piece 18 which may direct fluid coming in through the inlet 14*a* and passing through the evaporator core 16 back out through the evaporator core 16 toward the outlet 14*b*. The evaporator core 16 may include a plurality of flow paths (not shown) therethrough, as is known in the art.

While FIGS. 1 and 2 show an evaporator 12 oriented such that fluid flow inlet and outlet are on the same side thereof, any evaporator may be used within the context of the present invention. For example, embodiments of the present invention may be useful wherein fluid flows in one side of the evaporator and out an opposite side of the evaporator.

The evaporator 12 may also include a refrigerant distribution system 10 having a refrigerant distribution plate 20 for distributing refrigerant (not shown) into the evaporator. The distribution plate 20 may include a distribution manifold inlet 22 for receiving refrigerant, typically two phase refrigerant. The inlet can be located as shown and at various positions on the manifold as well at different angles.

The evaporator 12 may include a refrigerant recovery outlet 24 located on one side of the evaporator 12, opposite of the distribution plate 20. The refrigerant recovery outlet 24 may receive refrigerant (typically completely in the gaseous phase) for delivery back to a compressor (not shown). The refrigerant recovery outlet 24 may also assist in the recovery of oil. Oil (not shown) may pool in a bottom 26 portion of the refrigerant recovery outlet 24 and may be recovered therefrom.

Figure 3:
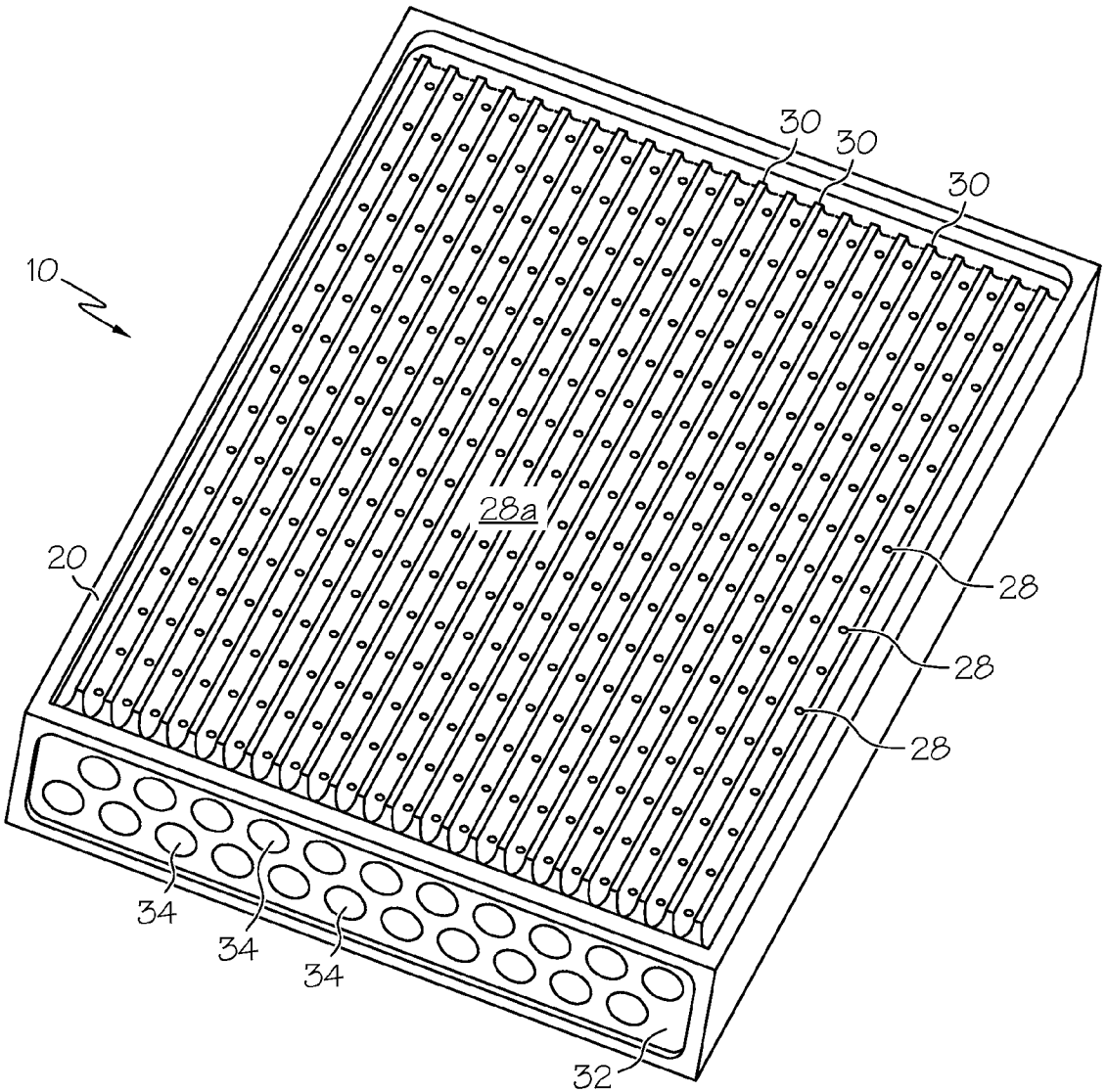
FIG. 3 is a perspective view of the refrigerant distribution system of FIG. 1, separate from the evaporator, according to an embodiment of the present invention.

Referring now to FIG. 3, there is shown a perspective view of the refrigerant distribution system 10 of FIG. 1, separate from the evaporator 12, according to an embodiment of the present invention. The refrigerant distribution system 10 may include the refrigerant distribution plate 20. A plurality of chambers 34 may be formed in the distribution plate 20. Each of the plurality of chambers 34 may fluidly communicate with a number of small diameter holes 28. The holes 28 may be located on one side 28*a* of the refrigerant distribution plate 20, thereby allowing refrigerant to flow through the holes 28 and into the evaporator core 16 (see FIG. 1). The plurality of chambers 34 may run parallel to each other and may extend from one end 32 of the distribution plate 20, lengthwise into the distribution plate 20. In one embodiment of the present invention, the plurality of chambers 34 may run lengthwise into the distribution plate 20, but may not fluidly communicate with the side opposite of the one end 32.

The distribution plate 20 may include a plurality of ridges 30. The ridges 30 may be spaced to match with a spacing of chambers on the evaporator core 16. This configuration may align each of the plurality of chambers 26 with each row of the evaporator core 16.

The plurality of holes 28 may be described as small diameter holes 28 and their diameter may be smaller than the diameter of the chambers 34. Typically, the diameter of the holes 28 may be from about 0.01% to about 50% of the diameter of the chambers 34. The holes 28 may be evenly spaced across the distribution plate 20, as shown in FIG. 3. Any number of holes 28 may be used per each chamber 34. Typically, from 0.5 to 10 holes 28 per inch may be used to distribute refrigerant from the chamber 34 to the evaporator core 16.

The above description and drawings describe a horizontal flow of refrigerant passing through an evaporator. However, the present invention should not be limited to horizontal flow. The distribution plate described above may be useful for distributing refrigerant into an evaporator core, regardless of the orientation of the flow of fluid therethrough. The present invention may be particularly useful where the flow of refrigerant through the evaporator core is not optimal (optimal being vertical upflow). Therefore, the present invention may be particularly useful where the flow of refrigerant is angled away from vertical, including horizontal refrigerant flow.

The motivation for orienting the evaporator in a manner that is not optimal for thermal performance may be oil recovery. A small portion of oil may escape the compressor and may separate from the refrigerant in the evaporator. This oil needs to be returned to the compressor for lubrication. The oil may be moved toward the compressor by the drag force induced by the vapor velocity. The drag must overcome gravity depending on orientation and surface tension forces. The best orientation for oil recovery may be where the refrigerant flows with gravity, aiding oil flow and recovery. This orientation may create other problems, including poor thermal performance and potential compressor slugging during startup.

Embodiments of the present invention may include an evaporator having horizontal refrigerant flow, which may negate the effect of gravity on oil recovery. In this orientation, the drag on the oil only has to overcome the surface tension forces to move the oil towards the compressor. This may result in better oil recovery as compared to orientations where the refrigerant is flowing upward.

Figure 4:
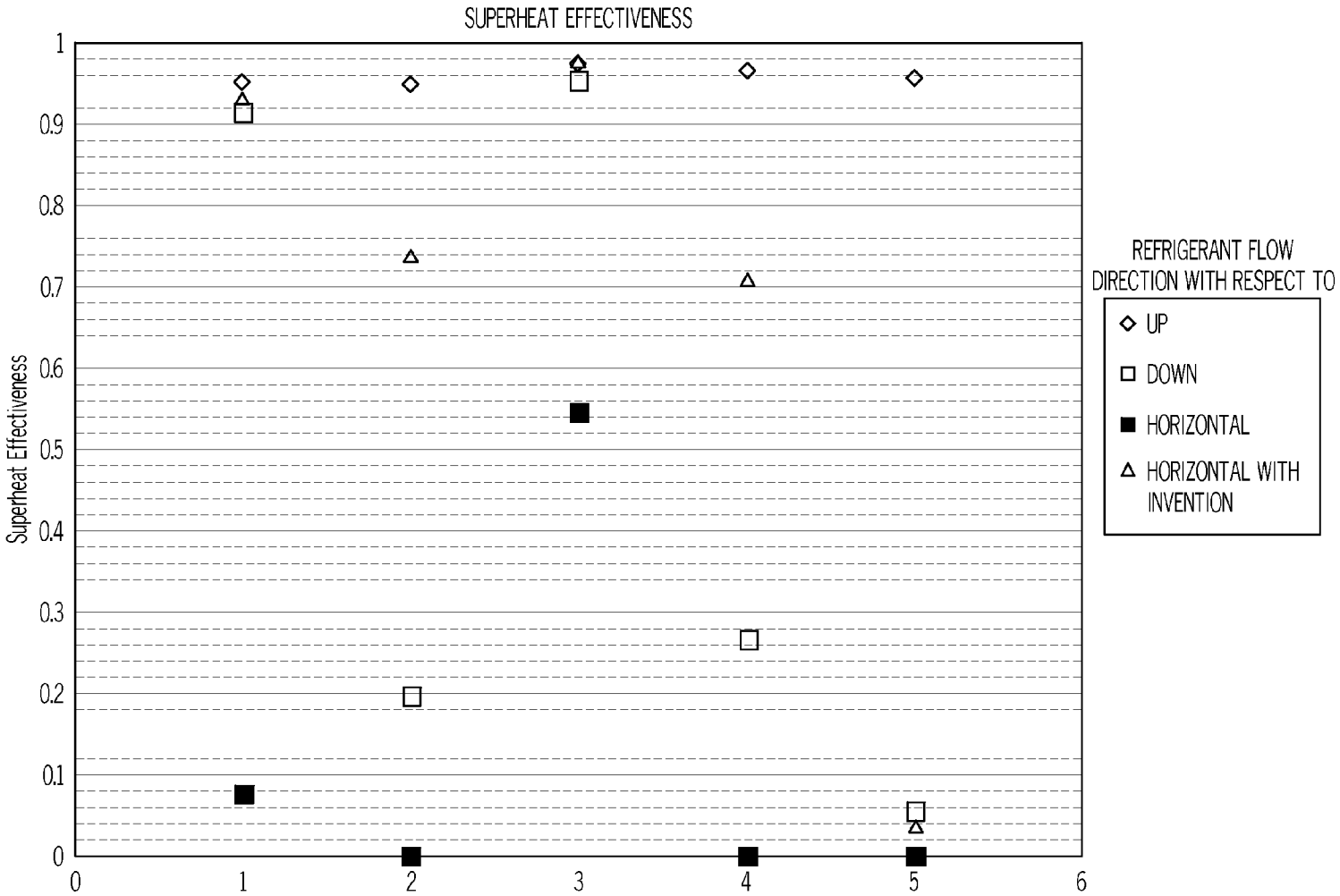
FIG. 4 is a graph comparing the superheat effectiveness of upflow, downflow and horizontal flow evaporators.

Referring now to FIG. 4, there is shown a graph showing the superheat effectiveness of upflow, downflow and horizontal flow evaporators as compared with the horizontal flow evaporator according to an embodiment of the present invention. As can be seen, the horizontal flow evaporator, using the distribution plate according to an embodiment of the present invention has a superheat effectiveness close to the same as the optimal refrigerant upflow configuration.

Figure 5:
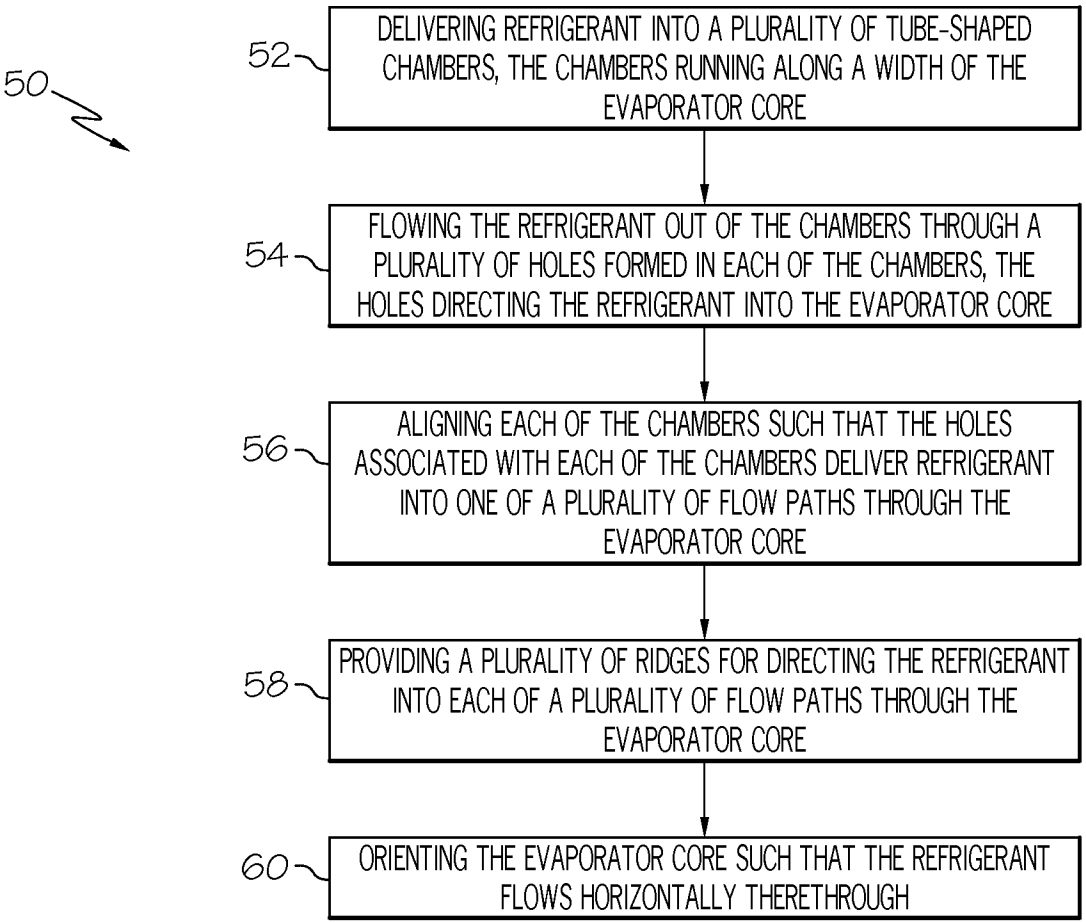
FIG. 5 is a flow chart describing a method for distributing refrigerant into an evaporator core according to an embodiment of the preset invention.

Referring to FIG. 5, there is shown a flow chart describing a method 50 for distributing refrigerant into an evaporator core according to an embodiment of the present invention. The method may include a first step 52 of delivering refrigerant into a plurality of tube-shaped chambers, the chambers running along a width of the evaporator core. The method may include a second step 54 of flowing the refrigerant out of the chambers through a plurality of holes formed in each of the chambers, the holes directing the refrigerant into the evaporator core.

The method 50 may also include a step 56 of aligning each of the chambers such that the holes associated with each of the chambers deliver refrigerant into one of a plurality of flow paths through the evaporator core. The method 50 may also include a further step 58 of providing a plurality of ridges for directing the refrigerant into each of a plurality of flow paths through the evaporator core. Finally, the method 50 may also include a step 60 of orienting the evaporator core such that the refrigerant flows horizontally therethrough. As described above, the holes may be formed with a diameter smaller than a diameter of each of the chambers.

It should be understood, of course, that the foregoing relates to exemplary embodiments of the invention and that modifications may be made without departing from the spirit and scope of the invention as set forth in the following claims.

We claim:

1. A refrigerant distribution plate comprising:

a plurality of refrigerant inlet chambers formed inside the refrigerant distribution plate, the plurality of refrigerant inlet chambers coupled with a manifold to receive refrigerant entering the refrigerant distribution plate and to disperse the received refrigerant to the plurality of refrigerant inlet chambers, the plurality of refrigerant inlet chambers extending lengthwise from a first end of the refrigerant distribution plate to a second end of the refrigerant distribution plate, wherein refrigerant flows in a direction from the first end of the refrigerant distribution plate toward the second end of the refrigerant distribution plate within each of the plurality of refrigerant inlet chambers;

a plurality of ridges disposed on a side of the refrigerant distribution plate, each ridge of the plurality of ridges extending from an outside end of the side of the refrigerant distribution plate such that adjacent ridges of the plurality of ridges form paths that extend from the refrigerant distribution plate to an evaporator core connected to the refrigerant distribution plate, each path being aligned with a flow row on the evaporator core, a plurality of hole sets, each of the plurality of hole sets formed between adjacent ridges, each of the hole sets fluidly communicating with one of the refrigerant inlet chambers located between adjacent ridges; and each one of the plurality of hole sets formed between adjacent ridges to form a refrigerant flow path to direct the refrigerant to the respective flow row on the evaporator core.

2. The refrigerant distribution plate of claim 1, wherein each of the plurality of refrigerant inlet chambers are oriented parallel to one another.

3. The refrigerant distribution plate of claim 1, wherein the holes have diameters smaller than diameters of the plurality of refrigerant inlet chambers.

4. An evaporator comprising:

an evaporator core with a plurality of flow paths receiving a fluid to be cooled;

a refrigerant distribution plate for distributing refrigerant into the flow paths of the evaporator core, wherein the refrigerant distribution plate comprises:

(a) a plurality of refrigerant inlet chambers formed inside the refrigerant distribution plate, the plurality of refrigerant inlet chambers coupled with a manifold to receive refrigerant entering the refrigerant distribution plate and to disperse the received refrigerant to the plurality of refrigerant inlet chambers, the plurality of refrigerant inlet chambers extending lengthwise from a first end of the refrigerant distribution plate to a second end of the refrigerant distribution plate;

(b) a plurality of ridges disposed on a ridge side of the refrigerant distribution plate, each ridge of the plurality of ridges extending from an outside end of the ridge side of the refrigerant distribution plate so that adjacent ridges form paths that extend from the refrigerant distribution plate to the evaporator core connected to the refrigerant distribution plate, each path being aligned with a flow row on the evaporator core, wherein all surfaces of the plurality of ridges and the ridge side are disposed about an exterior of the evaporator core; and (c) a plurality of hole sets, each one of the plurality of hole sets formed on the ridge side between adjacent ridges, each of the hole sets fluidly communicating with one of the refrigerant inlet chambers located between adjacent ridges, each one of the plurality of hole sets disposed between adjacent ridges to form a refrigerant flow path to direct the refrigerant to the respective flow row of the evaporator core.

5. The evaporator of claim 4, further comprising a refrigerant recovery outlet for receiving refrigerant from the evaporator core for delivery back to a compressor.

6. The evaporator of claim 4, wherein:

each of the plurality of hole sets are formed in one side of the refrigerant distribution plate; and the plurality of hole sets in one of the plurality of sets of holes associated with each of the plurality of refrigerant inlet chambers are spaced along a length of the refrigerant distribution plate.

7. The evaporator of claim 4, wherein a flow of refrigerant through the evaporator core is co-planar with a flow of the refrigerant in the refrigerant distribution plate.

8. A method for distributing refrigerant into an evaporator core that includes a plurality of flow paths receiving a fluid to be cooled; a refrigerant distribution plate connected to the evaporator core and includes a plurality of refrigerant inlet chambers, the plurality of refrigerant inlet chambers extending lengthwise from a first end of the refrigerant distribution plate to a second end of the refrigerant distribution plate; each inlet chamber being aligned with only one of a plurality of flow paths of the evaporator core, a plurality of ridges disposed on a side of the refrigerant distribution plate, each ridge of the plurality of ridges extending from an outside end of the side of the refrigerant distribution plate such that adjacent ridges of the plurality of ridges form paths that extends from the first end of the refrigerant distribution plate to the evaporator core, the method comprising the steps of:

delivering refrigerant directly into the plurality of inlet chambers;

flowing the refrigerant from the first end of the refrigerant distribution plate toward the second end of the refrigerant distribution plate within each one of the plurality of inlet chambers, and out of each one of the plurality of inlet chambers through hole sets directing the refrigerant from the inlet chambers into only one of the flow paths on the evaporator core that is aligned with said inlet chamber.

9. The method of claim 8, further comprising passing a flow of refrigerant through the evaporator core and the refrigerant distribution plate such that the refrigerant flow through the evaporator core is co-planar with the flow through the refrigerant distribution plate.

10. The method of claim 8, wherein the plurality of hole sets have a diameter smaller than a diameter of the inlet chambers.

11. The refrigerant distribution plate of claim 1, wherein one of the plurality of refrigerant inlet chambers is closed at a portion adjacent to the second end of the refrigerant distribution plate.

* * * * *